US006217191B1

(12) United States Patent
Wu et al.

(10) Patent No.: US 6,217,191 B1
(45) Date of Patent: Apr. 17, 2001

(54) MULTIPLE LAMP SOCKET DEVICE

(76) Inventors: Jeng-Shyong Wu, No. 14, Alley 1, Lane 326, Shyr-Plin Road; Johnny Chen, No. 504-1, Chung-Hua Road, Section 4, both of Hsin-Chu City (TW)

( * ) Notice: Subject to any disclaimer, the term of this patent is extended or adjusted under 35 U.S.C. 154(b) by 0 days.

(21) Appl. No.: 09/087,831

(22) Filed: May 29, 1998

(51) Int. Cl.[7] ..... F21V 21/00

(52) U.S. Cl. ..... 362/249; 362/226; 362/391; 313/318.01; 439/379

(58) Field of Search ..... 362/226, 249, 362/391, 219, 228, 184; 313/318.01, 318.12; 439/232, 241, 379, 680, 677, 619, 699.2, 375

(56) References Cited

U.S. PATENT DOCUMENTS

| | | | | |
|---|---|---|---|---|
| 3,286,008 | | 11/1966 | Power et al. . | |
| 3,654,586 | * | 4/1972 | Winkler | 339/49 R |
| 4,631,650 | | 12/1986 | Ahroni . | |
| 4,676,126 | | 6/1987 | Polastri . | |
| 4,764,129 | * | 8/1988 | Jones | 439/677 |
| 4,764,854 | * | 8/1988 | Matsune | 362/226 |
| 4,779,177 | | 10/1988 | Ahroni . | |
| 4,807,098 | | 2/1989 | Ahroni . | |
| 4,970,632 | | 11/1990 | Tseng . | |
| 4,999,751 | | 3/1991 | Chen . | |
| 5,001,615 | | 3/1991 | Stefanelli . | |
| 5,148,698 | | 9/1992 | Dischler . | |
| 5,193,255 | | 3/1993 | Tseng et al. . | |
| 5,395,246 | * | 3/1995 | Punako | 439/680 |
| 5,701,051 | * | 12/1997 | Lin | 362/318.1 |

* cited by examiner

*Primary Examiner*—Cassandra Spyrou
*Assistant Examiner*—Leo Boutsikaris
(74) *Attorney, Agent, or Firm*—McGlew and Tuttle, P.C.

(57) ABSTRACT

A lamp socket device for a decorative lighting string is provided. The device has a lamp bulb, a lamp base, a lamp holder, contact sheet and multiple electrical wires. The combination of a lamp bulb or a lamp base and lamp holder have acceptance, selectively combinable, aspects with directional aspects between the fixed lamp bulb, lamp base and lamp holder whereas the other unfixed lamp bulb, lamp base and lamp holders of a similar but different type have non-acceptance, non-combinable or exclusive aspects.

10 Claims, 20 Drawing Sheets

MULTIPLE LAMP SOCKET DEVICE

FIELD OF THE INVENTION

The invention relates to lamp socket devices in Christmas lighting strings.

BACKGROUND OF THE INVENTION

Conventional lamp socket devices in Christmas lighting strings have a lamp bulb, lamp base, lamp holder and contact copper sheet connected to the electrical wires. In general different specifications of lamp bulb are not used. The lamp bulb is only used in certain conditions or situations. Further, a lighting string used in series or parallel does not have any limit or control. Only words in a label or a written explanation warning is provided on such strings as sold. Thus, users may neglect to heed such explanations. This can present the danger of over heating, something catching fire, etc. due to the improper use. Therefore, a fire disaster may occur, potentially causing great loss in life and property.

The use a bulbs with a screw base in the lamp socket device is based on one type, such as with 1OW, 2OW . . . 20OW bulbs used in households appliances. The same to use E 26 base and holder. It should be limited to use in various situations. However, only explanation or warning is done. It has not any effective method or design to protect the users to assembly or replace the device without error whereby to guarantee the safety.

Several decades, a number of lighting strings in series or parallel have different specifications of lamp bulbs (1), which is to use the same specification of lamp base (2) or lamp holder (3). This only relies on the control of manufacture and a written explanation or warning in order to prevent the users from improper use. Especially, the consumers are not familiar and cannot recognize products and distinguish the specifications, i.e. it is difficult to apply common sense to them. Thus, a disaster can result due to neglect. The conventional products use different lamp bulbs (1), use the same specification of lamp base (2) or lamp holder (3), such as in the prior arts of U.S. Pat. Nos. 3,286,008; 4,631,650; 4,679,126; 4,779,177; 4,807,098; 4,970,632; 4,999,751; 5,001,615; 5,193,255 and 5,418,698. Though the combination of lamp bulb, lamp base or lamp holder has a limit in vertical or horizontal direction, the purpose is, under the combination, to make the conductor wire of bulb only able to contact with the electric wire or contact the copper sheet so as to complete the electrical circuit.

SUMMARY AND OBJECTS OF THE INVENTION

The primary object of the present invention is to avoid the possibility of neglect in manufacture and the error in use. The combination between the lamp bulb, lamp base and lamp holder has acceptance, combinable, selective, directional and monopolization characteristics between the fixed lamp bulb, lamp base and lamp holder. The device with another unfixed lamp bulb, lamp base and lamp holder has non-acceptance, non-combinable or exclusive aspects. Such as a device is only able to use a low bulb, it is fixed to being arranged in the first kind of lamp base or lamp holder, and a bulb other than a low one is completely unable to be used in the first kind of lamp base or lamp holder. Further, with the kind of series lighting string using a bulb with 12 Volts in ten bulbs, the Voltage is fixed in 120 V and only this A-type lamp base and lamp holder can be used and it is not possible to use other types of lamp base and lamp holder at all. The other specifications of bulbs in 6 V, 3.5 V, 2.5 V are not combinable with the A-type of lamp base and lamp holder. Further, the bulbs in 6 V, 3.5 V, 2.5 V are only combinable in B-type, C-type, D-types of lamp base and lamp holder respectively.

In order to obtain acceptance, combinable, selective, directional and monopolization characteristics between the fixed lamp bulb, lamp base and lamp holder and the non-acceptance, non-combinable or exclusive aspects as well, many methods can be used and the structures are various. The methods and structures can be used in a number of lamp bulbs, lamp bases and lamp holders. It is unable to list them one by one. However, five groups of lamp bulb, lamp base and lamp holder of push-in type are used as the detailed description thereafter other objects and features will become apparent when the description of preferred embodiments is taken in conjunction with the annexed drawings

BRIEF DESCRIPTION OF THE DRAWINGS

In the drawings:

FIG. 1 is a perspective view of the first embodiment of the lamp socket device of the present invention showing the structure combination ofthe assemblies.

FIG. 2 is a perspective of the second embodiment of the lamp socket device of the present invention the structure combination of the assemblies.

FIG. 3 is a perspective of the third embodiment ofthe lamp socket device ofthe present invention showing the structure combination of the assemblies.

FIG. 4 is a perspective of the fourth embodiment of the lamp socket device of the present invention showing the structure combination of the assemblies.

FIG. 5 is a perspective view of a further embodiment of the lamp socket device of the present invention showing the structure combination ofthe assemblies.

FIG. 6 is a perspective of a further embodiment ofthe lamp socket device ofthe present invention showing the structure combination of the assemblies.

FIG. 8 is a perspective of a further embodiment ofthe lamp socket device of the present invention showing the structure combination of the assemblies.

FIG. 9 is a perspective view of a further embodiment of the lamp socket device of the present invention showing the structure combination ofthe assemblies.

FIG. 10 is a perspective view of a further embodiment of the lamp socket device of the present invention showing the structure combination of the assemblies.

FIG. 11 is a perspective view of a further embodiment of the lamp socket device of the present invention showing the structure combination of the assemblies.

FIG. 12 is a perspective view of a further embodiment of the lamp socket device of the present invention showing structure combination of the assemblies.

FIG. 13 is a perspective of a further embodiment of the lamp socket device of the present invention showing the structure combination of the assemblies.

FIG. 14 is a perspective of a further embodiment ofthe lamp socket device ofthe present invention showing the structure combination of the assemblies.

FIG. 15 is a perspective of a further embodiment of the lamp socket device of the present invention showing the structure combination of the assemblies.

FIG. 16 is a perspective of a further embodiment of the lamp socket device of the present invention showing the structure combination of the assemblies.

FIG. 17 is a perspective view of a further embodiment of the lamp socket device of the present invention showing the structure combination of the assemblies.

FIG. 18 is a perspective view of a further embodiment of the lamp socket device of the present invention showing the structure combination of the assemblies.

FIG. 19 is a perspective of a further embodiment of the lamp socket device of the present invention showing the structure combination of the assemblies.

FIG. 20 is a perspective of a further embodiment of the lamp socket device of the present invention showing the structure combination of the assemblies.

DESCRIPTION OF THE PREFERRED EMBODIMENT

Figure 1G:
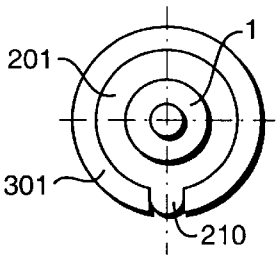
FIGS. 1F and 1G are perspective views of the lamp holder and its cross-section shown after the combination.
Figure 1F:
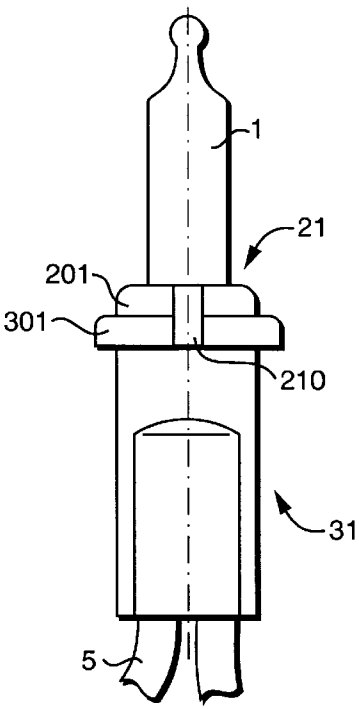
Figure 1E:
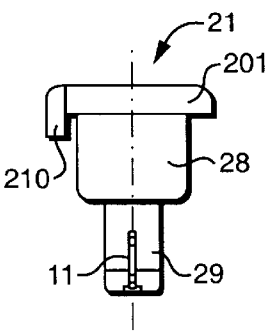
FIG. 1E is the other perspective view with the 90 degree direction.
Figure 1D:
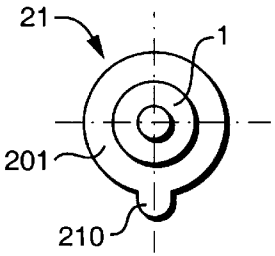
FIGS. 1C and 1D are perspective views showing the lamp base and its cross-section.
Figure 1C:
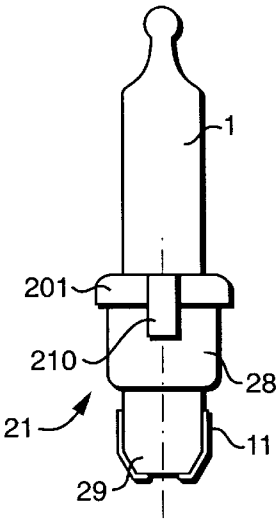
Figure 1B:
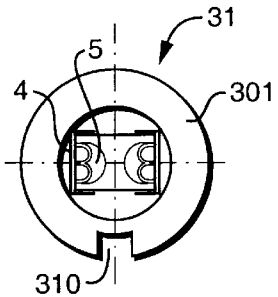
FIGS. 1A and 1B are perspective views showing the lamp holder and its cross-section.
Figure 1A:
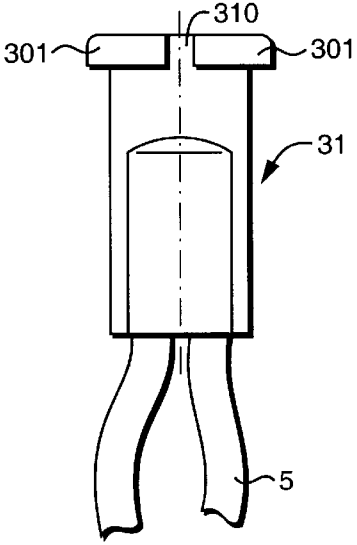
Figure 2G:
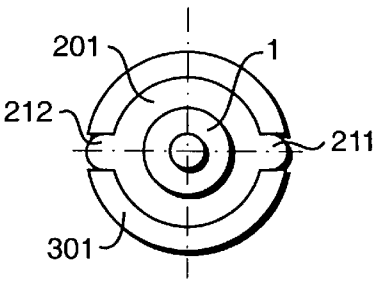
FIGS. 2F and 2G are perspective views of the lamp holder and its cross section shown after the combination.
Figure 2F:
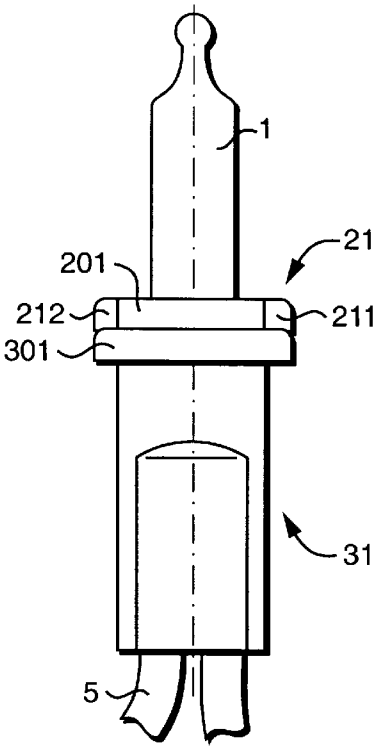
Figure 2E:
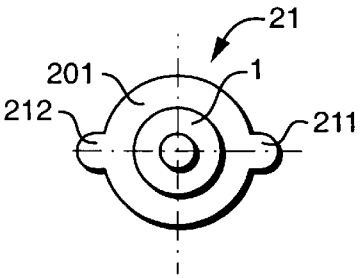
FIGS. 2D and 2E are perspective views showing the lamp base and its cross-section.
Figure 2D:
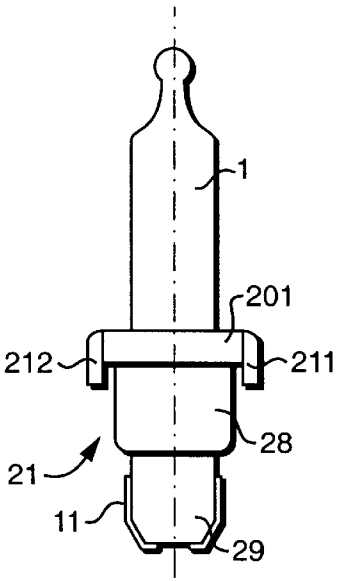
Figure 2C:
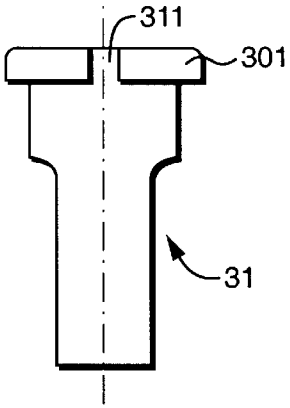
FIG. 2C is another perspective view with the 90 degree direction.
Figure 2B:
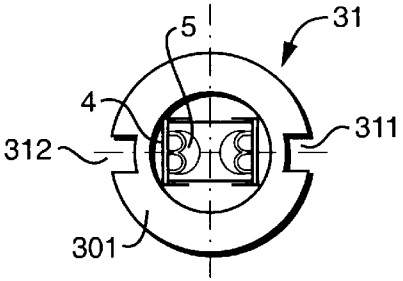
FIGS. 2A and 2B are perspective views showing the lamp holder and its cross-section.
Figure 2A:
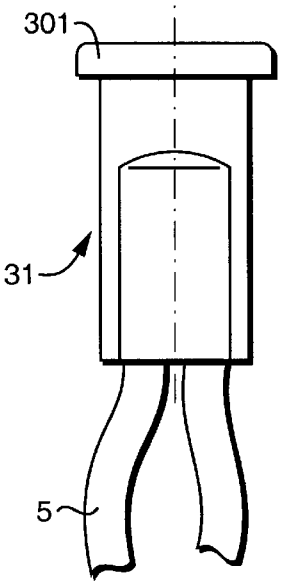
Figure 3F:
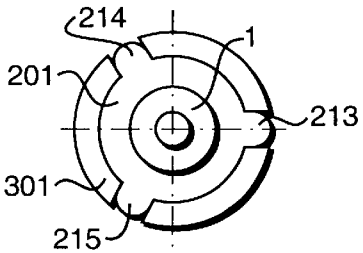
FIGS. 3E and 3F are perspective views of the lamp holder and its cross-section shown after the combination.
Figure 3E:
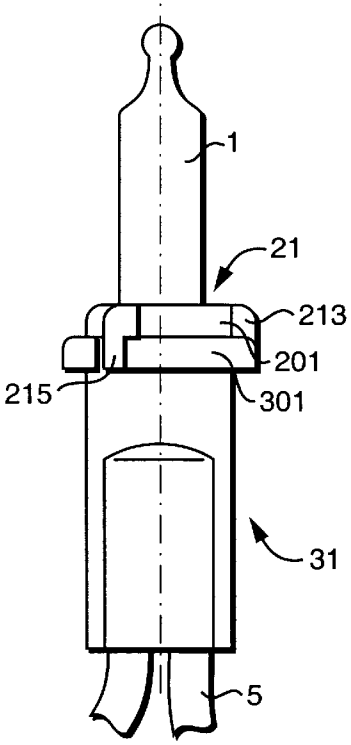
Figure 3D:
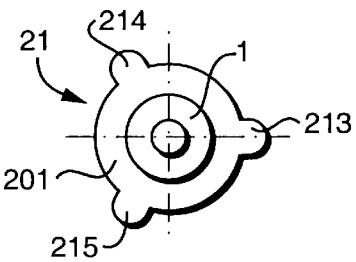
FIGS. 3C and 3D are perspective views showing the lamp base and its cross-section.
Figure 3C:
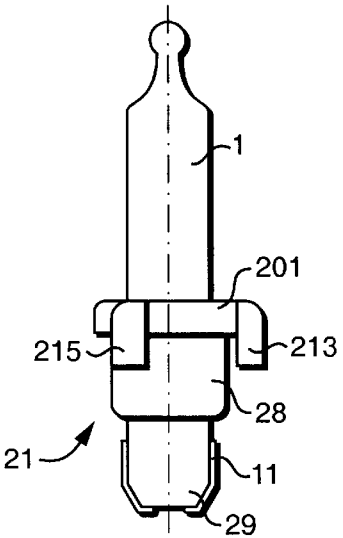
Figure 3B:
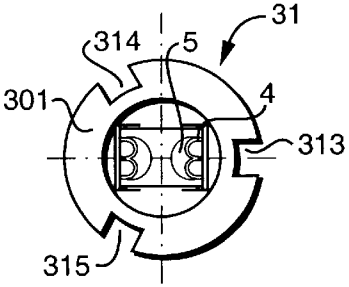
FIGS. 3A and 3B are perspective views showing the lamp holder and its cross-section.
Figure 3A:
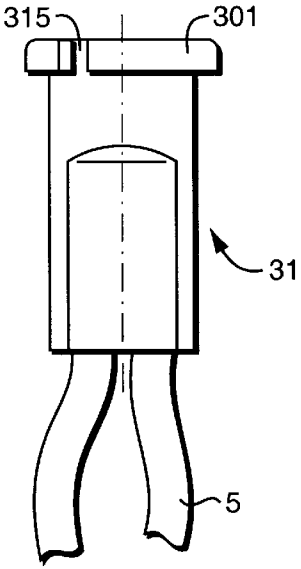

The illustration of the lamp socket devices of the present invention shows lamp bulbs 1, lamp bases 21, 22, 23, 24, 25, lamp holders 31, 32, 33, 34, 35, contact copper sheets 4 and electric wires 5. The lamp bulb 1 has tungsten filament sealed in the vacuum part and the conductor wire 11 extended out of the bulb, the lamp base having a neck 28 and base 29, part of lamp bulb 1 passing through the hole of the neck 28 in the lamp base, its conductor wire 11 passing through the base 29 of the lamp base and bent along with the side wall of the base 29, contacting with contact copper sheet 4 connected to the electrical wires whereby to form an electrical circuit. The lamp base has a rectangular base 29 in the cross-section part, the conductor wire 11 of the lamp bulb 1 along with the short edge of the rectangular base 29; the relative distance of the two contact copper sheets 4 being larger than their width whereby to form the cross section part becoming rectangular hole, closely adjoin the rectangular base of lamp base, only the oriented direction limit ofthe combination of long edge with long edge, and short edge with short edge in order to confirm the conductor wires II contacted to the contact copper sheet 4 so as to complete a electrical circuit.

Figures 4A, 4B, 4C, 4D, 4E, 4F:
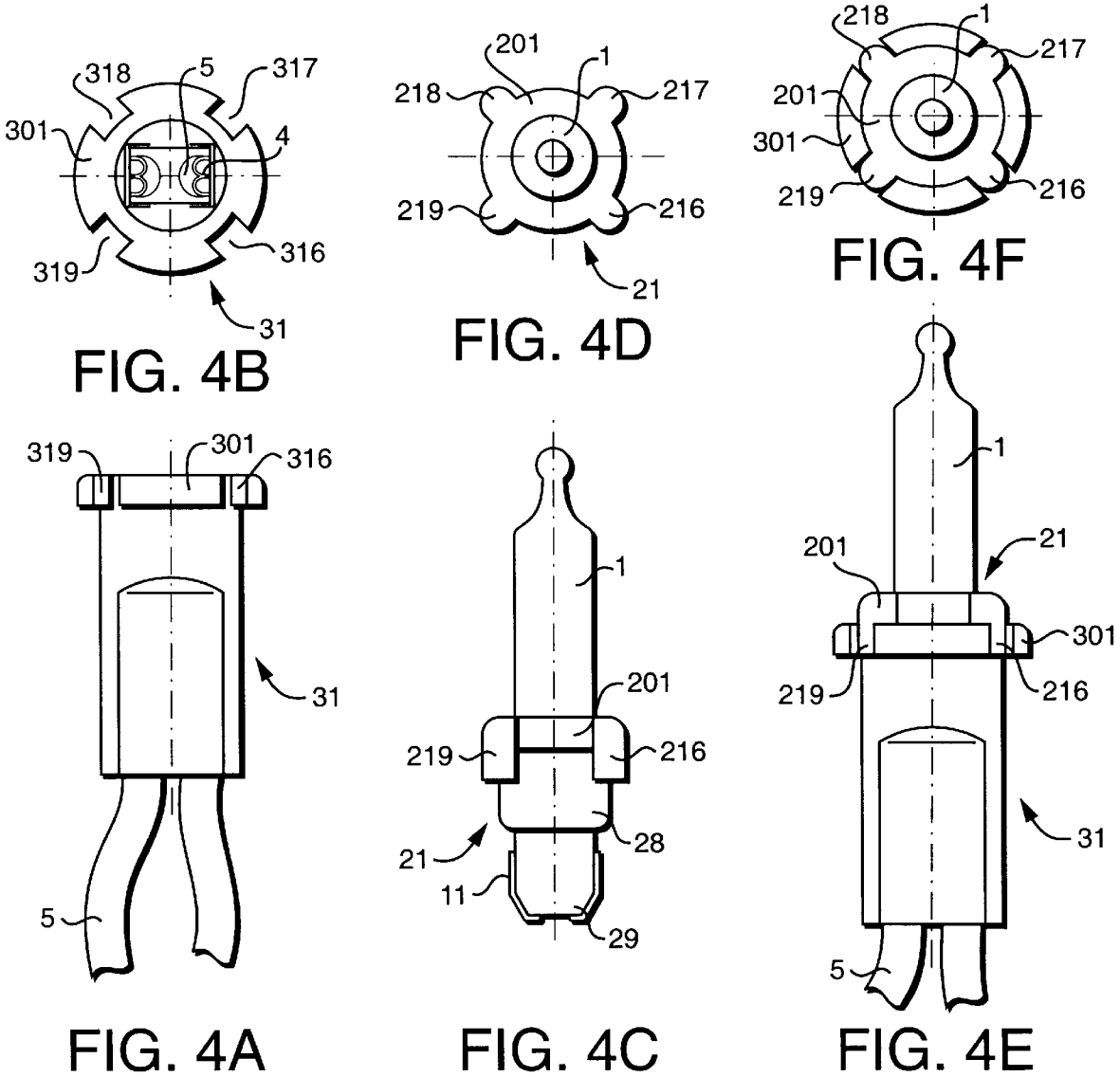
FIGS. 4A and 4B are perspective views showing the lamp holder and its cross-section.
FIGS. 4C and 4D are perspective views showing the lamp base and its cross-section.
FIGS. 4E and 4F are perspective views of the lamp holder and its cross-section shown after the combination.
Figure 5G:
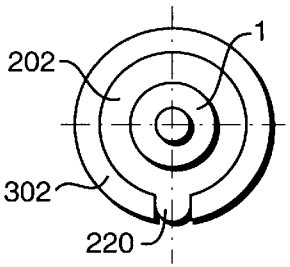
FIGS. 5F and 5G are perspective views of the lamp holder and its cross-section shown after the combination.
Figure 5F:
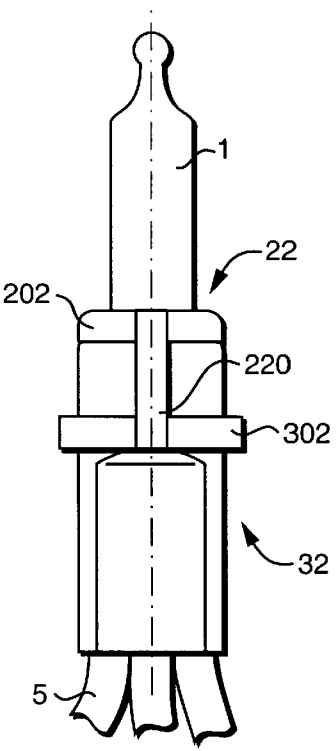
Figure 5E:
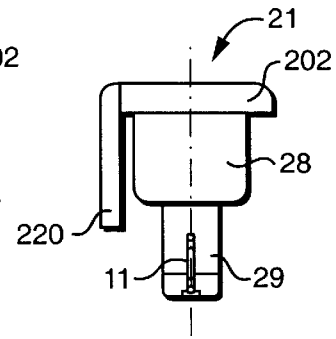
FIG. 5E is another perspective view with the 90 degree direction.
Figure 5D:
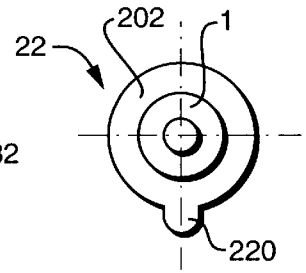
FIGS. 5C and 5D are perspective views showing the lamp base and its cross-section.
Figure 5C:
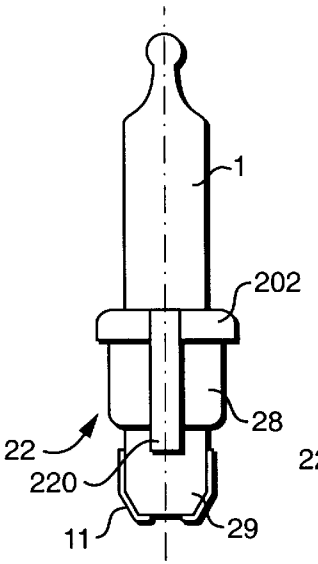
Figure 5B:
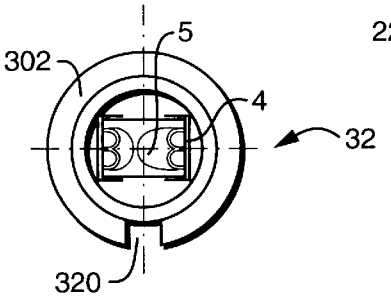
FIGS. 5A and 5B are perspective views showing the lamp holder and its cross-section.
Figure 5A:
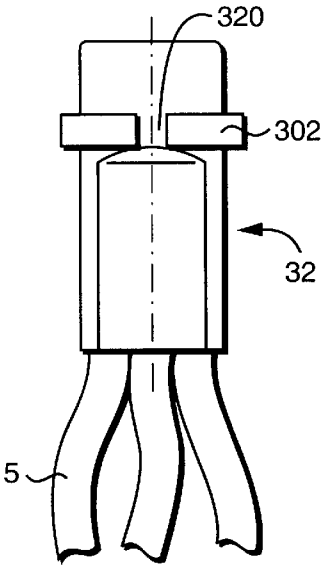
Figure 6G:
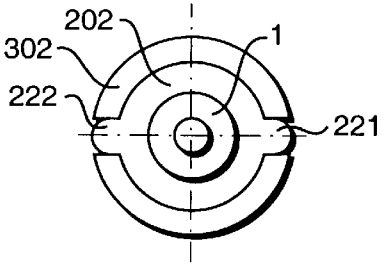
FIGS. 6F and 6G are perspective views of the lamp holder and its cross section shown after the combination.
Figure 6F:
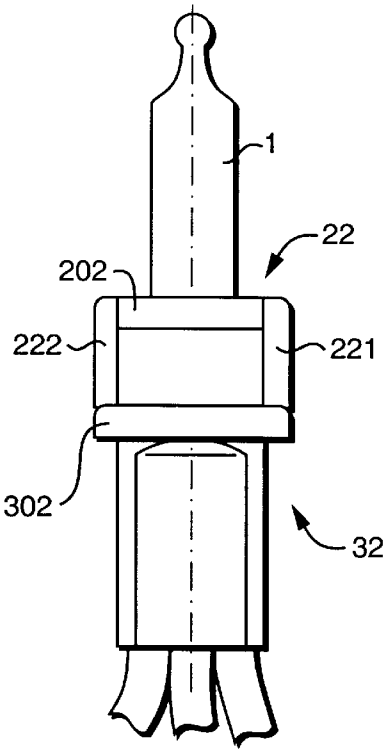
Figure 6E:
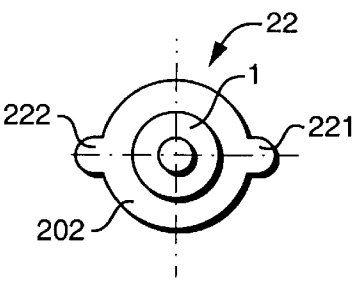
FIGS. 6D and 6E are perspective views showing the lamp base and its cross-section.
Figure 6D:
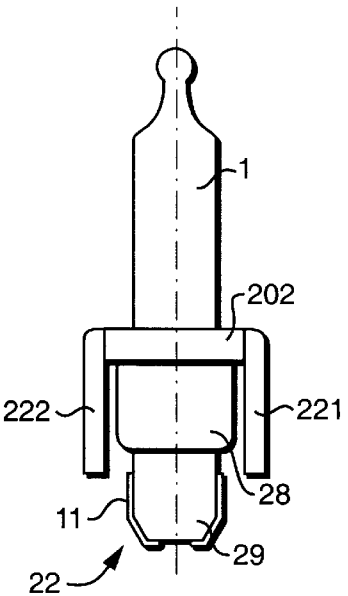
Figure 6C:
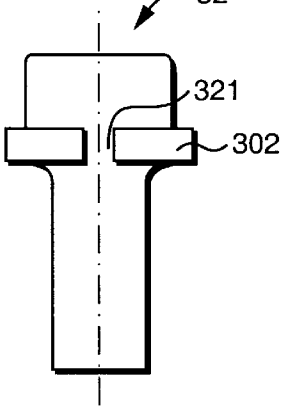
FIG. 6C is the other perspective view with the 90 degree direction.
Figure 6B:
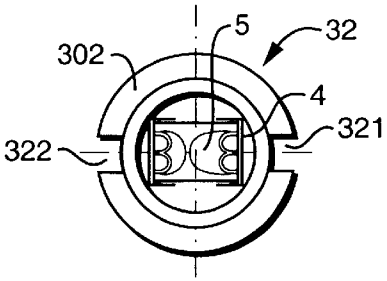
FIGS. 6A and 6B are perspective views showing the lamp holder and its cross-section.
Figure 6A:
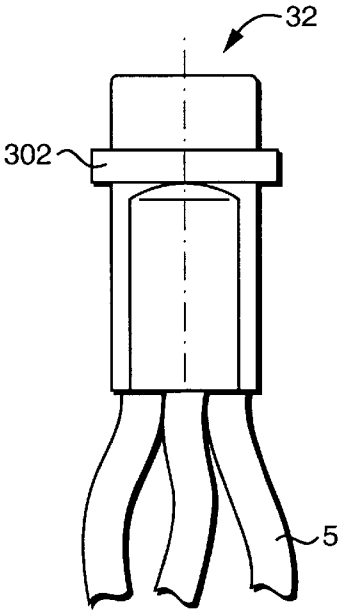
Figure 7F:
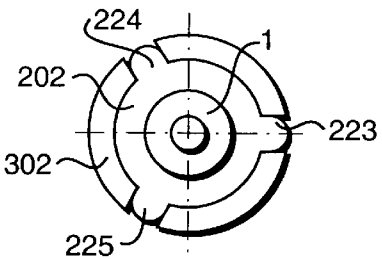
FIGS. 7F and 7G are perspective views of the lamp holder and its cross-section shown after the combination.
Figure 7E:
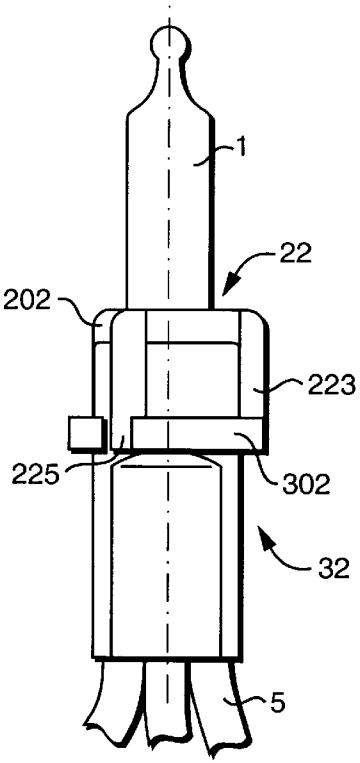
FIG. 7 is a perspective of a further embodiment of the lamp socket device of the present invention showing the structure combination of the assemblies.
FIGS. 7A and 7B are perspective views showing the lamp holder and its cross-section.
FIGS. 7C and 7D are perspective views showing the lamp base and its cross-section.
Figure 7D:
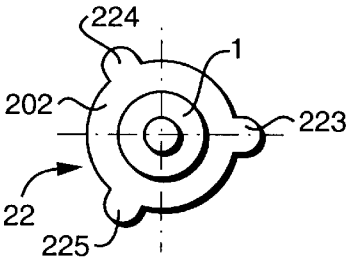
Figure 7C:
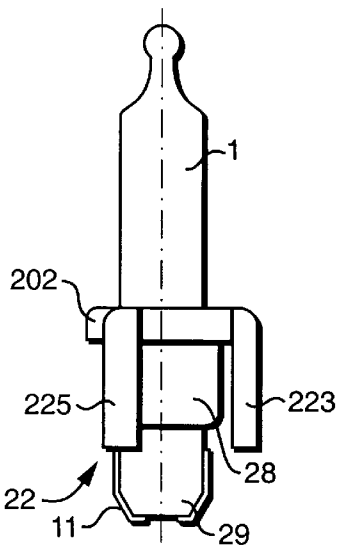
Figure 7B:
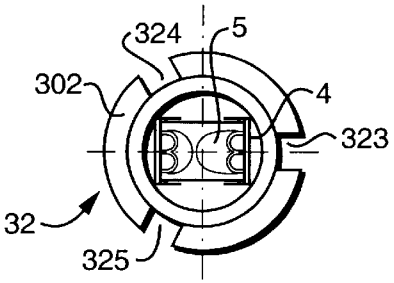
Figure 7A:
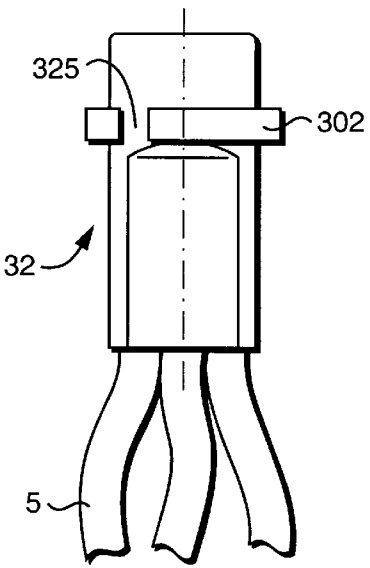
Figure 8F:
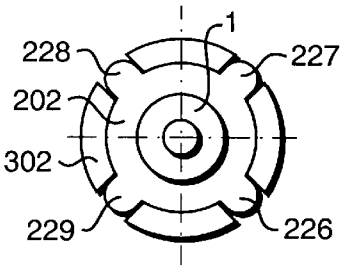
FIGS. 8E and 8F are perspective views of the lamp holder and its cross-section shown after the combination.
Figure 8E:
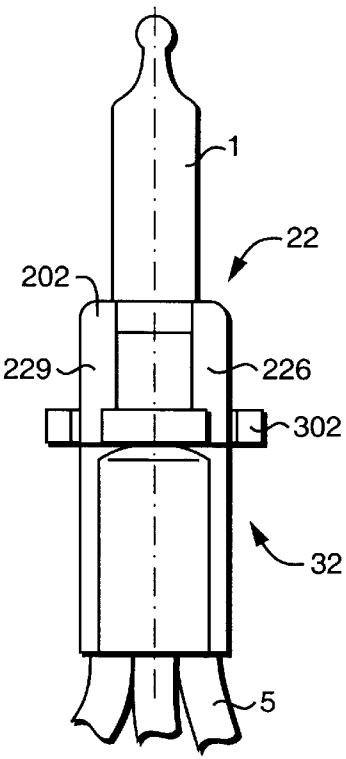
Figure 8D:
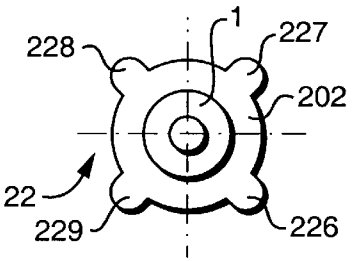
FIGS. 8C and 8D are perspective views showing the lamp base and its cross-section.
Figure 8C:
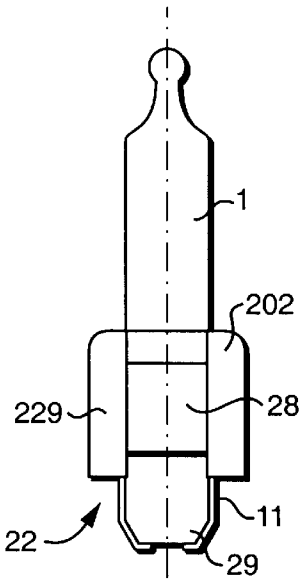
Figure 8B:
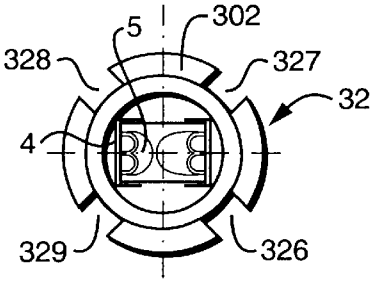
FIGS. 8A and 8B are perspective views showing the lamp holder and its cross-section.
Figure 8A:
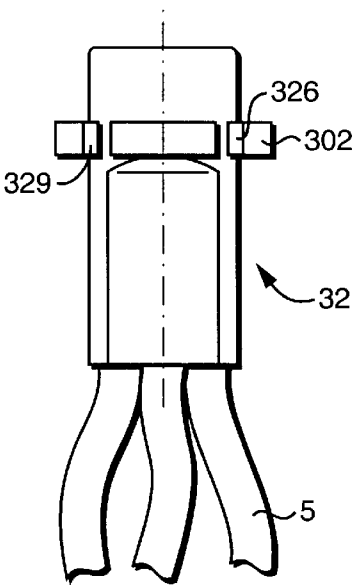
Figure 9B:
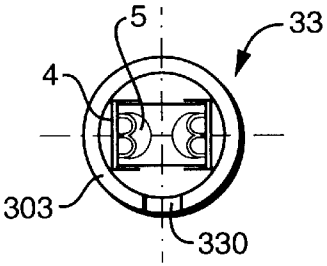
FIGS. 9A and 9B are perspective views showing the holder and its cross-section.
Figure 9C:
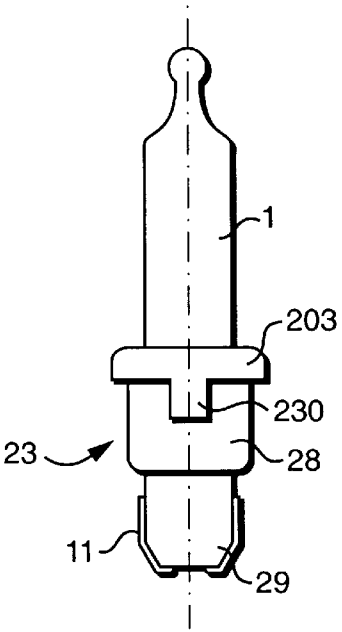
FIGS. 9C and 9D are perspective views showing the lamp base with lamp bulb and its cross-section.
Figure 9D:
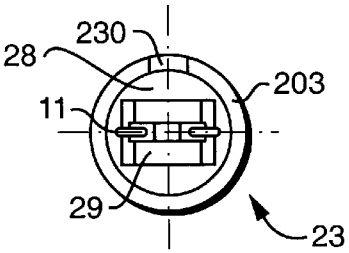
Figure 9E:
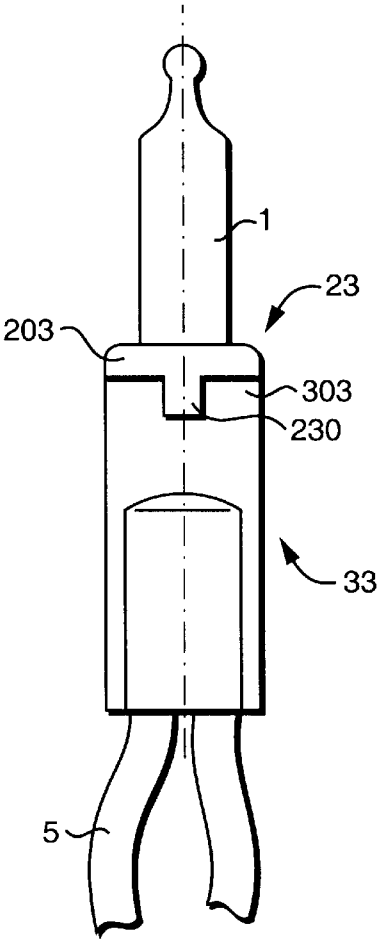
FIG. 9E is a perspective view of the lamp holder shown after the combination.
Figure 9A:
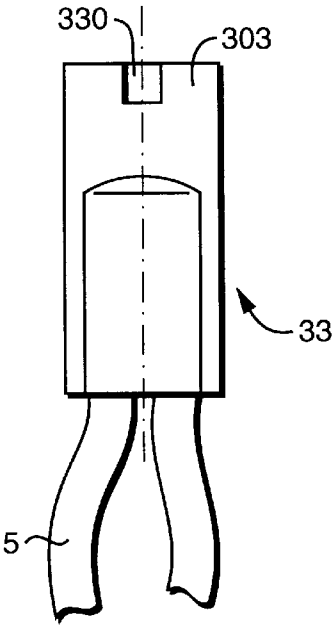
Figure 10B:
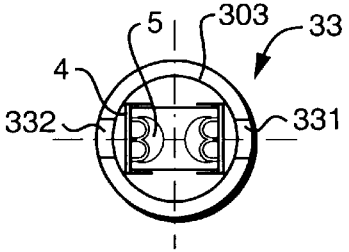
FIGS. 10A and 10B are perspective views showing the lamp holder and its cross-section.
Figure 10A:
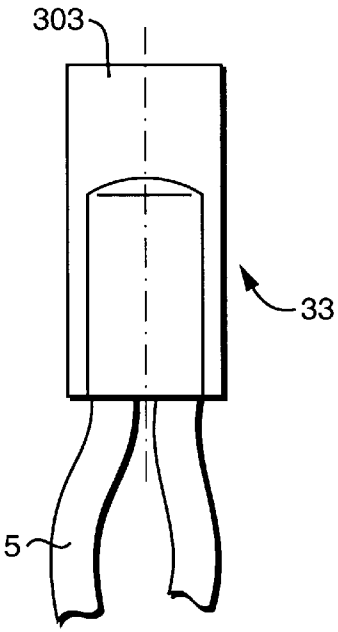
Figure 10C:
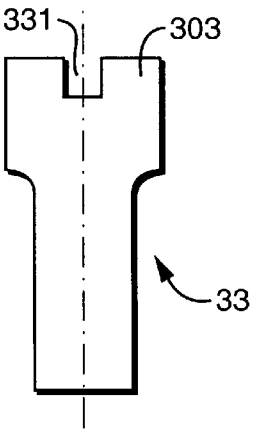
FIG. 10C is another perspective view with the 90 degree direction.
Figure 10D:
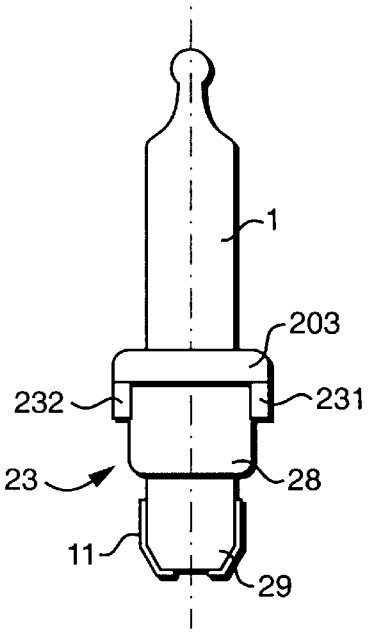
FIGS. 10D and 10E are perspective views showing the lamp base and its cross-section.
Figure 10E:
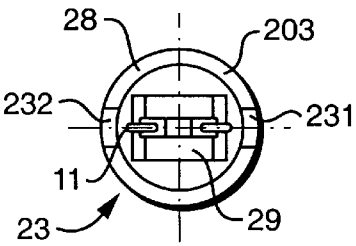
Figure 10F:
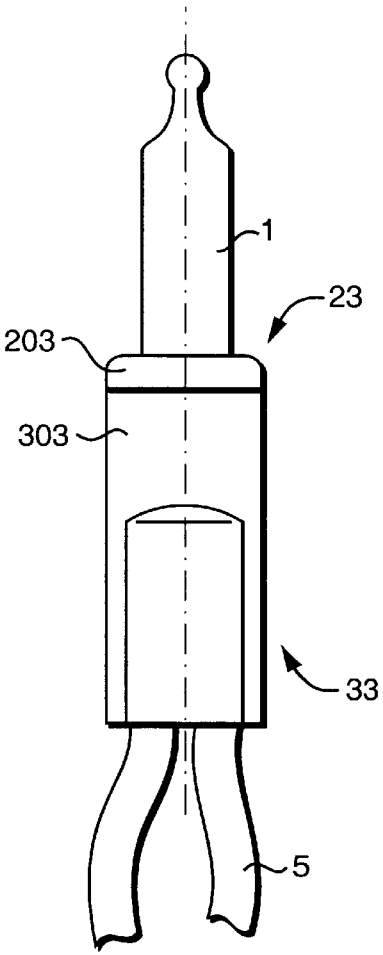
FIGS. 10F is a perspective view ofthe lamp holder shown after the combination.
Figure 11B:
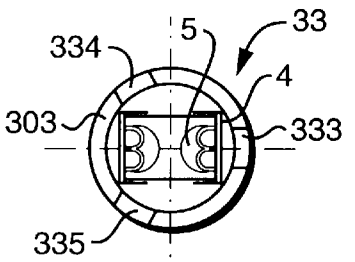
FIGS. 11A and 11B are perspective views showing the lamp holder and its cross-section.
Figure 11C:
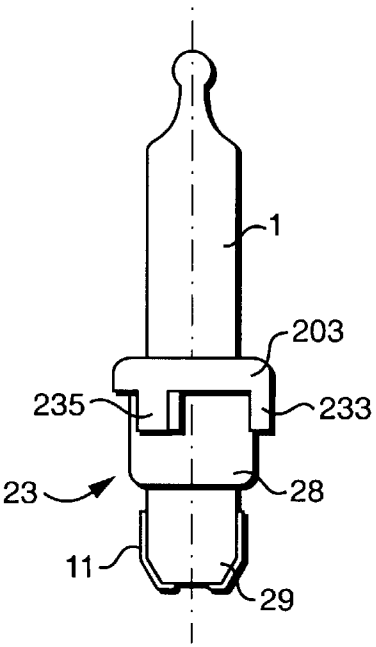
FIGS. 11C and 11D are perspective views showing the lamp base with lamp bulb and its cross-section.
Figure 11E:
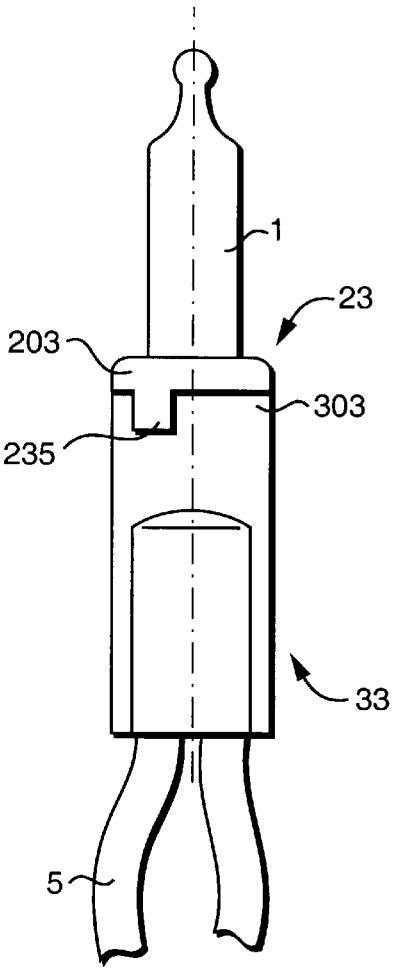
FIG. 11E is a perspective view of the lamp holder shown after the combination.
Figure 11A:
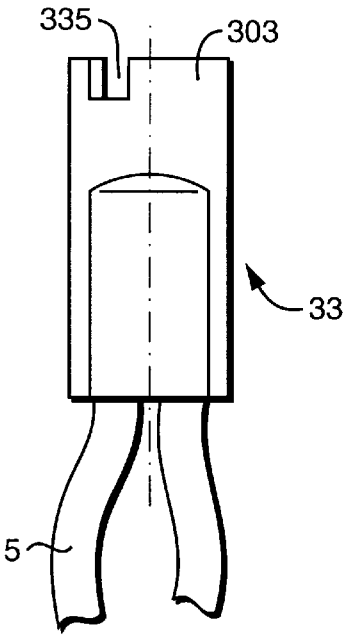
Figure 11D:
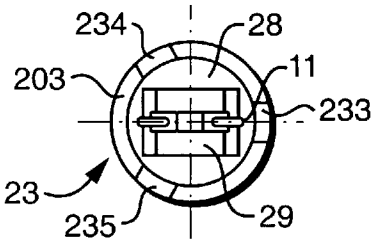
Figure 12B:
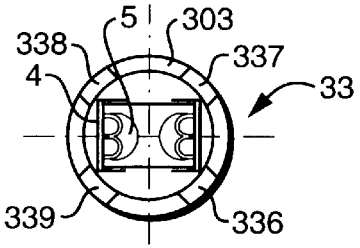
FIGS. 12A and 12B are perspective views showing the lamp holder and its cross-section.
Figure 12C:
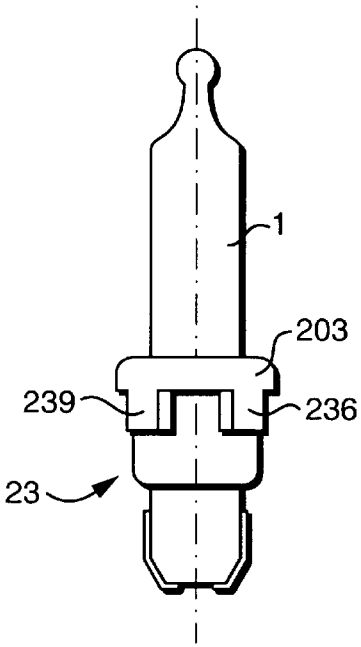
FIGS. 12C and 12D are perspective views showing the lamp base with lamp bulb and its cross-section.
Figure 12E:
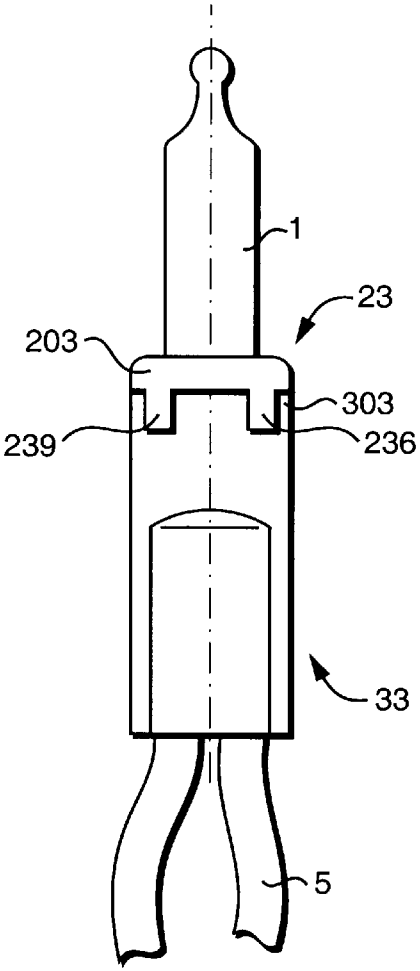
FIG. 12E is a perspective view of the lamp holder shown after the combination.
Figure 12D:
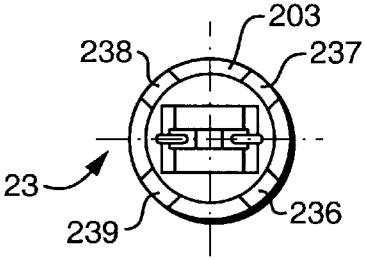
Figure 12A:
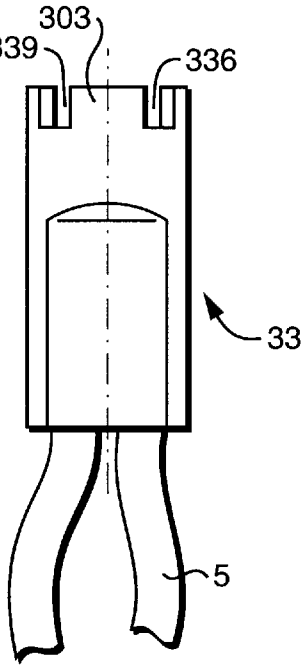
Figure 13B:
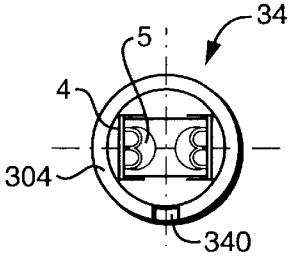
FIGS. 13A and 13B are perspective views showing the lamp holder and its cross-section.
Figure 13D:
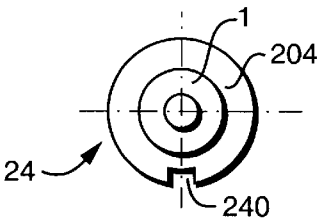
FIGS. 13C and 13D are perspective views showing the lamp base and its cross-section.
Figure 13F:
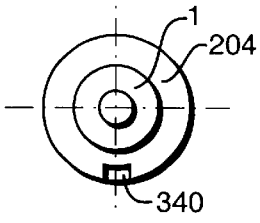
FIGS. 13E and 13F are perspective views of the lamp holder and its cross-section shown after the combination.
Figure 13A:
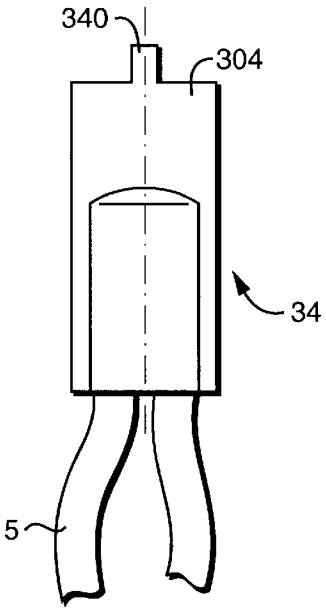
Figure 13C:
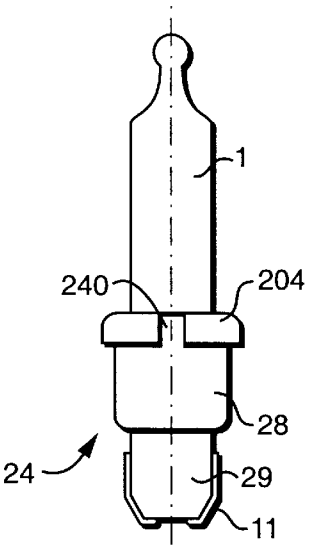
Figure 13E:
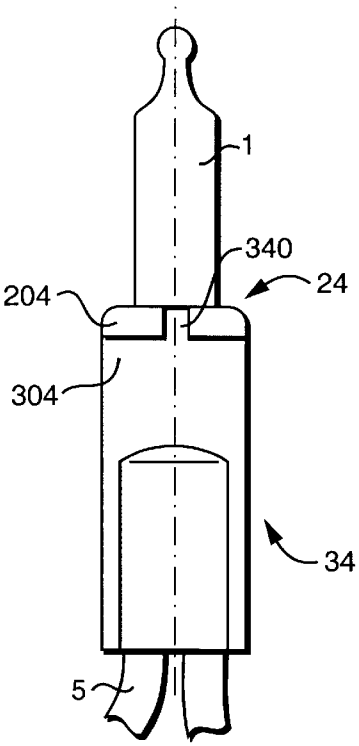
Figure 14F:
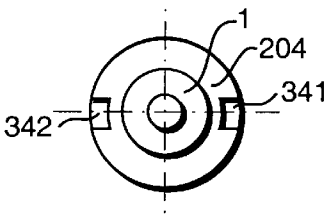
FIGS. 14E and 14F are perspective views of the lamp holder and its cross-section shown after the combination.
Figure 14D:
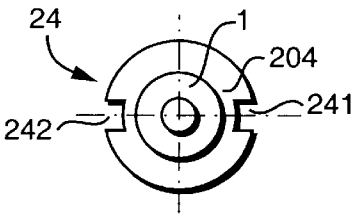
FIGS. 14C and 14D are perspective views showing the lamp base and its cross-section.
Figure 14B:
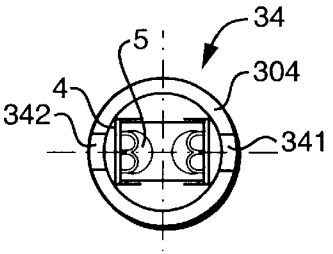
FIGS. 14A and 14B are perspective views showing lamp holder and its cross-section.
Figure 14E:
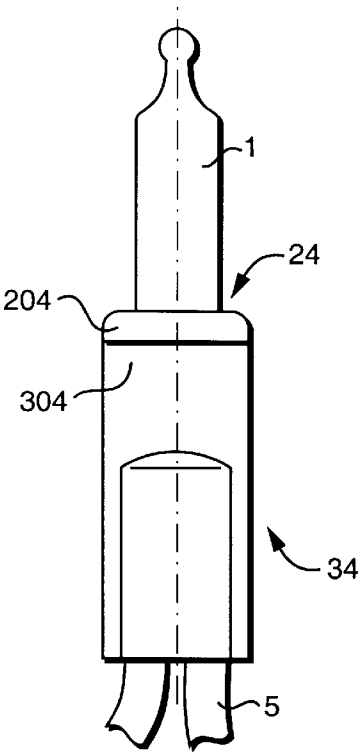
Figure 14C:
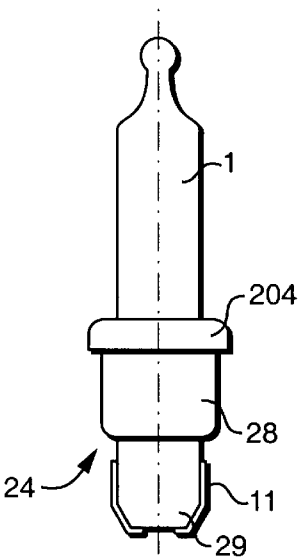
Figure 14A:
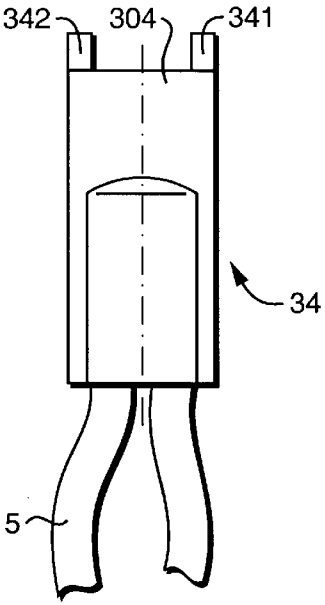
Figure 15F:
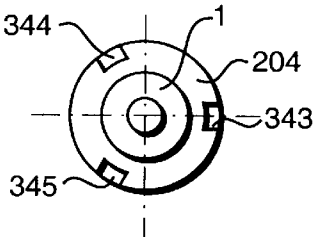
FIGS. 15E and 15F are perspective views of the lamp holder and its cross-section shown after the combination.
Figure 15E:
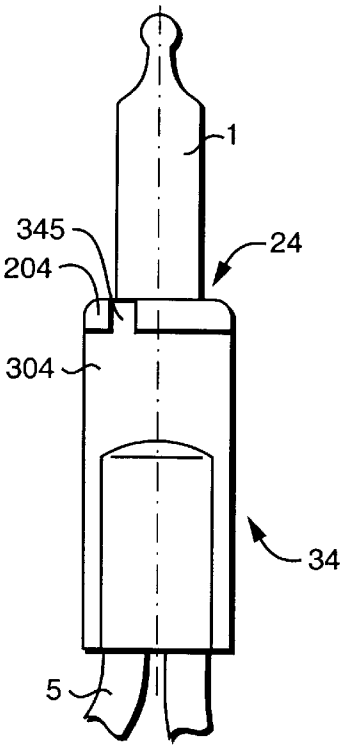
Figure 15D:
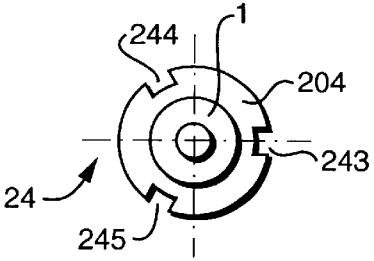
FIGS. 15C and 15D are perspective views showing the lamp base and its cross-section.
Figure 15C:
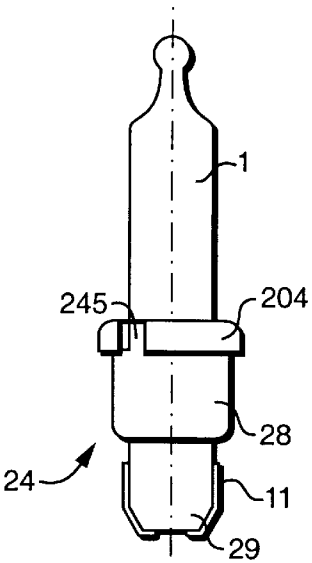
Figure 15B:
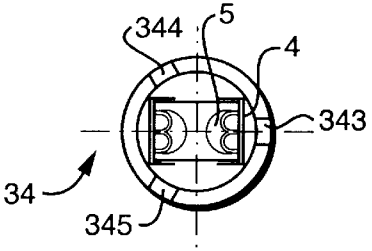
FIGS. 15A and 15B are perspective views showing the lamp holder and its cross-section.
Figure 15A:
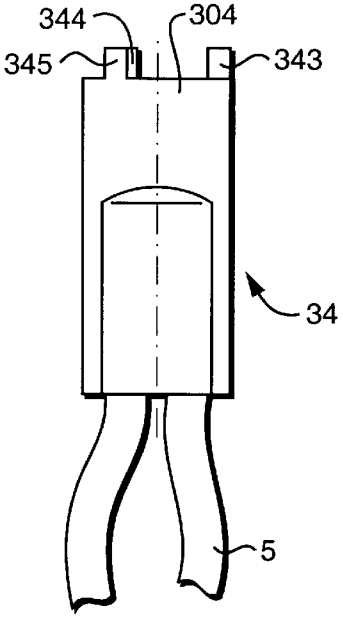
Figure 16F:
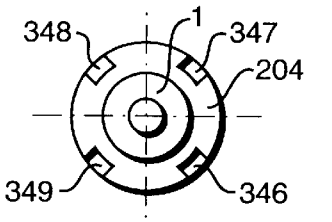
FIGS. 16E and 16F are perspective views of the lamp holder and its cross-section shown after the combination.
Figure 16D:
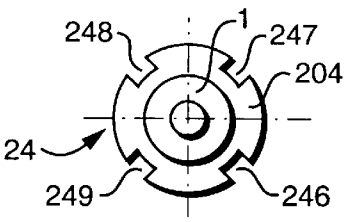
FIGS. 16C and 16D are perspective views showing the lamp base and its cross-section.
Figure 16B:
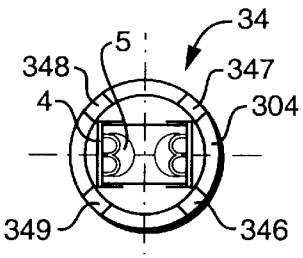
FIGS. 16A and 16B are perspective views showing the lamp holder and its cross-section.
Figure 16E:
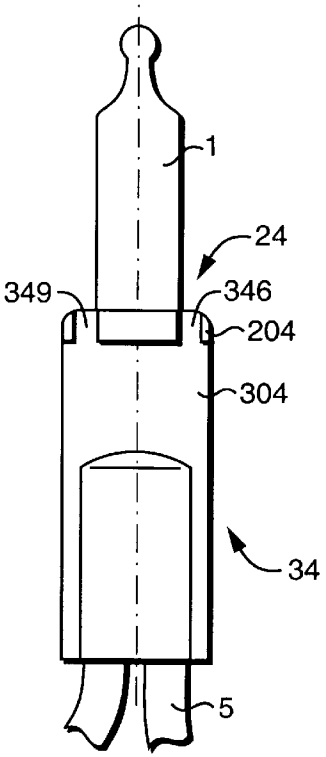
Figure 16C:
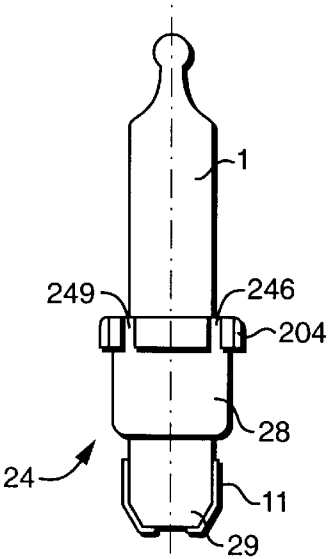
Figure 16A:
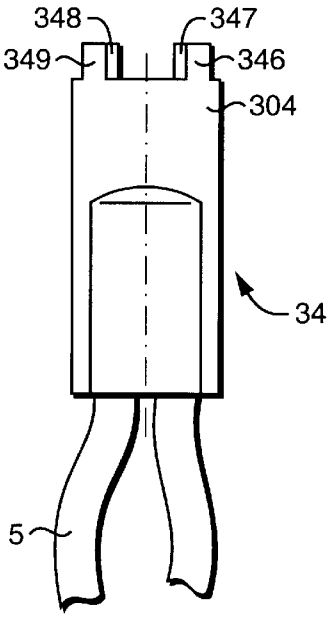
Figure 17G:
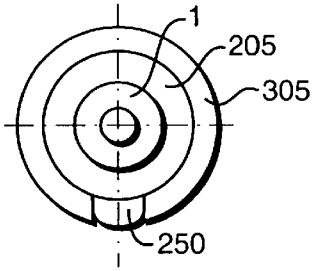
FIGS. 17F and 17G are perspective views of the lamp holder and its cross-section shown after the combination.
Figure 17F:
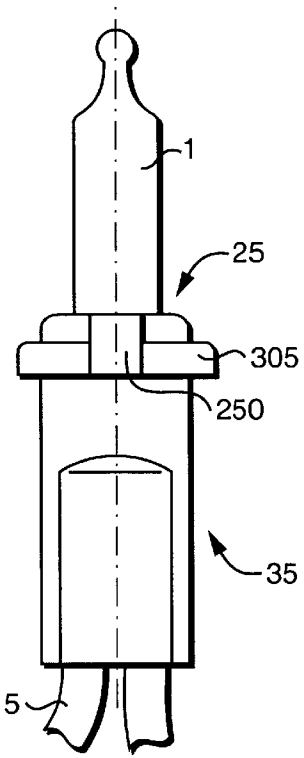
Figure 17E:
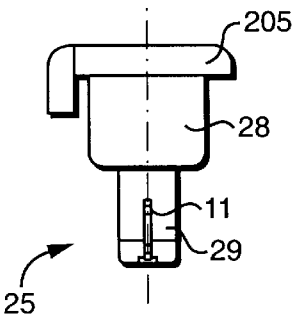
FIG. 17E is the other perspective view with the 90 degree direction.
Figure 17D:
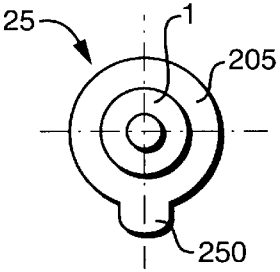
FIGS. 17C and 17D are perspective views showing the lamp base and its cross-section.
Figure 17C:
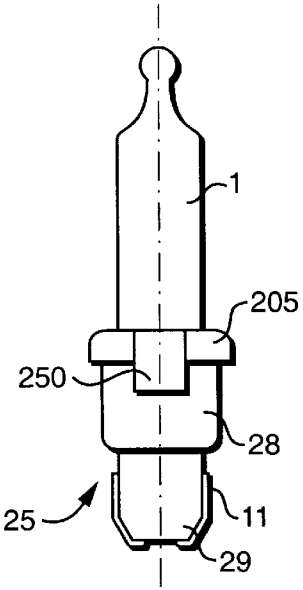
Figure 17B:
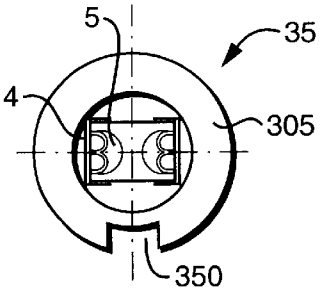
FIGS. 17A and 17B are perspective views showing the lamp holder and its cross-section.
Figure 17A:
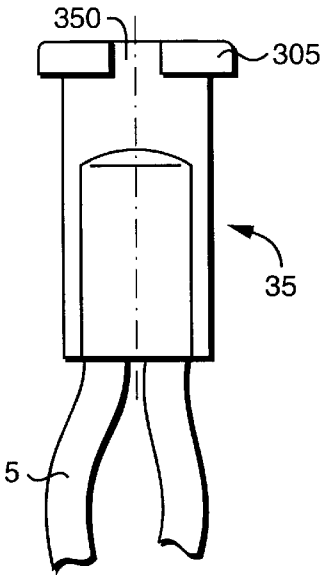
Figure 18G:
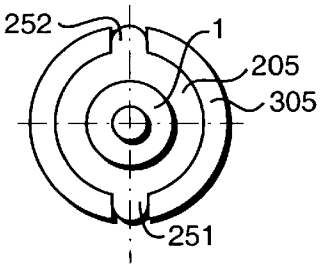
FIGS. 18F and 18G are perspective views of the lamp holder and its cross-section shown after the combination.
Figure 18F:
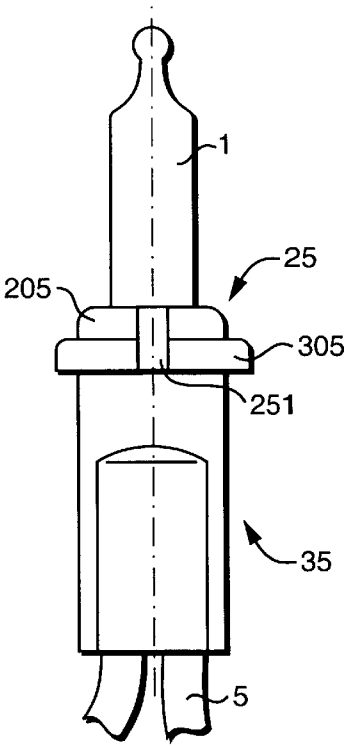
Figure 18E:
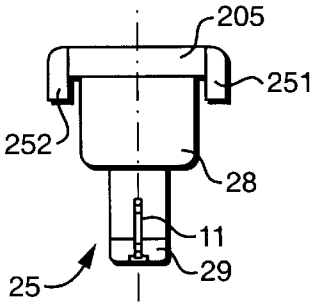
FIG. 18E is the other perspective view with the 90 degree direction.
Figure 18D:
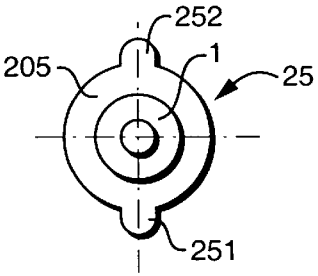
FIGS. 18C and 18D are perspective views showing the lamp base and its cross-section.
Figure 18C:
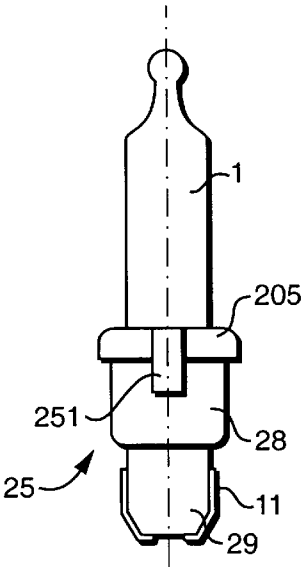
Figure 18B:
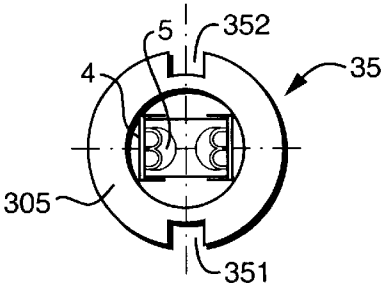
FIGS. 18A and 18B are perspective views showing lamp holder and its cross-section.
Figure 18A:
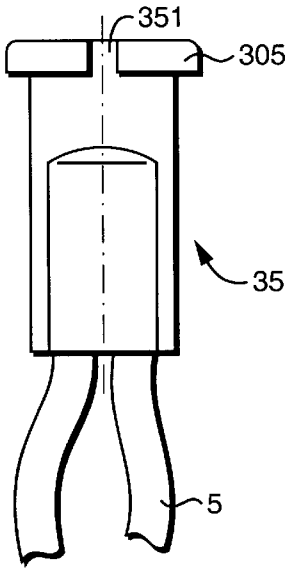
Figure 19F:
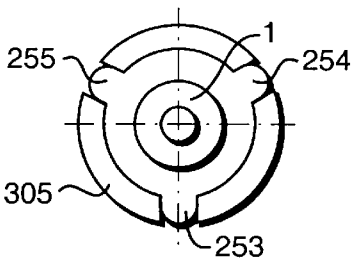
FIGS. 19E and 19F are perspective views of the lamp holder and its cross-section shown after the combination.
Figure 19E:
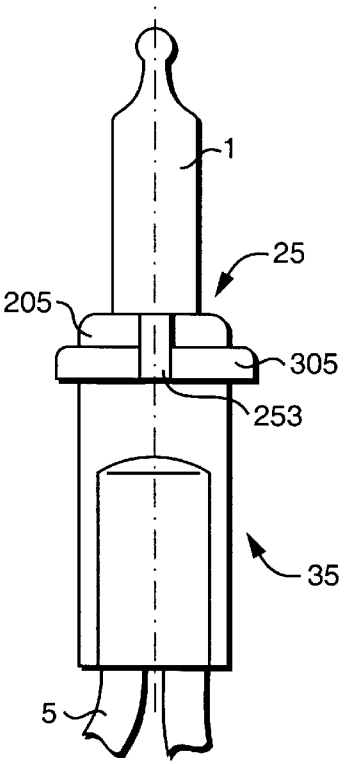
Figure 19D:
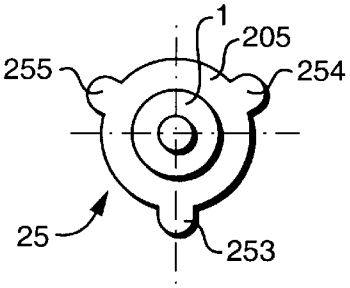
FIGS. 19C and 19D are perspective views showing the lamp base and its cross-section.
Figure 19C:
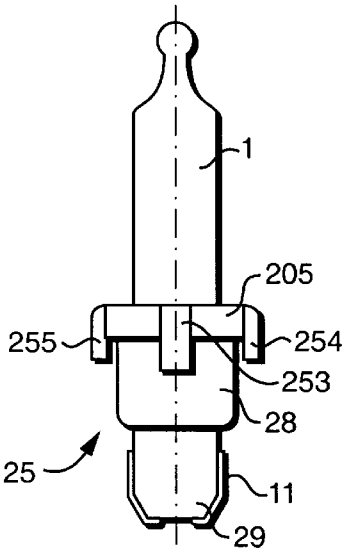
Figure 19B:
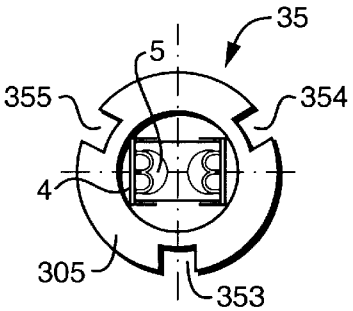
FIGS. 19A and 19B are perspective views showing the lamp holder and its cross-section.
Figure 19A:
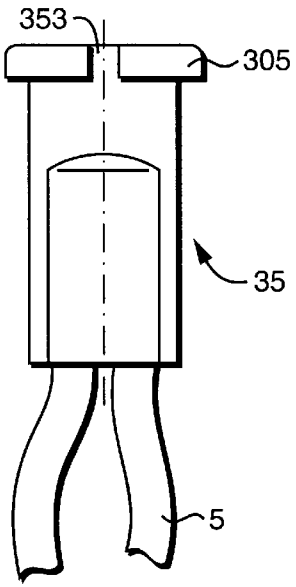
Figure 20F:
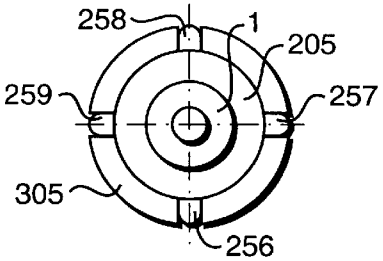
FIGS. 20E and 20F are perspective views of the lamp holder and its cross-section shown after the combination.
Figure 20E:
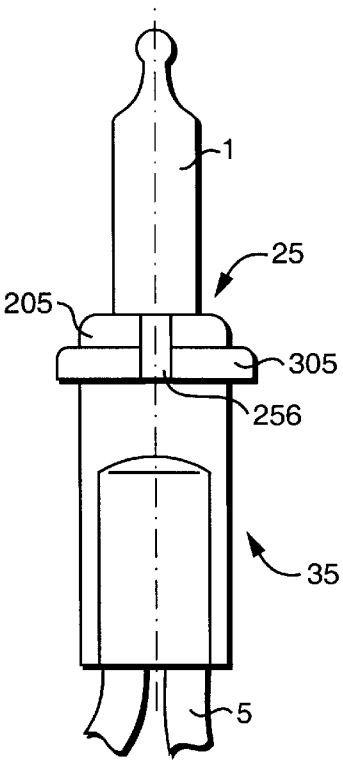
Figure 20D:
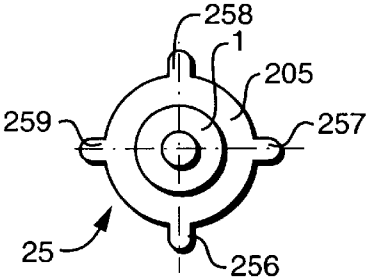
FIGS. 20C and 20D are perspective views showing the lamp base and its cross-section.
Figure 20C:
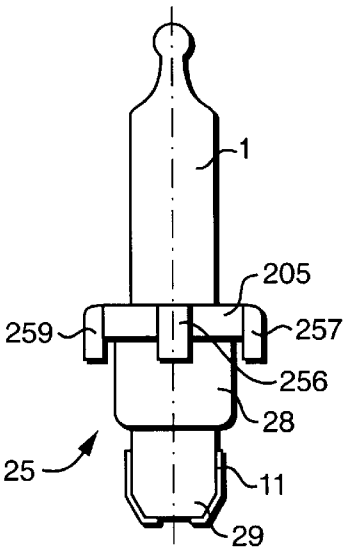
Figure 20B:
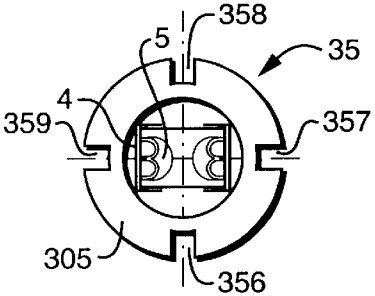
FIGS. 20A and 20B are perspective views showing the lamp holder and its cross-section.
Figure 20A:
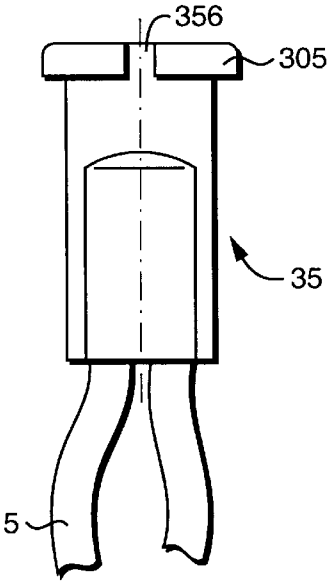

According to the lamp socket device in FIGS. 1, 2, 3 and 4, an upper rim of neck 28 of the lamp base 21 has a annular protuberance 201, on the protuberance 201, four posts 210, 211, 212, 213, 214, 215 and 216, 217, 218, 219 respectively extended toward the direction of the neck 28; the opening rim of be connected portion between the lamp holder 31 with lamp bulb 1 and lamp base 21 having annular protuberance 301, four openings or grooves 310, 311, 312, 313, 314, 315 and 316, 317, 318, 319 on the protuberance 301. In FIG. 1, one post 210 and one opening or groove 310 are to be set up in the same side. When combining these, the base 29 and neck 28 of the lamp base 21 are inserted into the opening of lamp holder, the post 210 simultaneously inserted into the opening or groove 310 and fixed in the right position. In FIG. 2, two posts 211, 212 and two openings or grooves 311,312 are on the base of the post 210 and opening or groove 310 in FIG. 1 used as a reference to set up 90 degree respectively, when combining, the two posts 211, 212 being simultaneously inserted into two openings or grooves 311, 312 and fixed in the right position. In FIG. 3, three posts 213, 214,215 and three openings or grooves 313, 314, 315 are on the base of the post 210 and opening or groove 310 in FIG. 1 used as a reference and according to clockwise or counterclockwise direction to set up 30, 150 and 270 degree respectively, when combining, the three posts 213, 214, 215 being simultaneously inserted into three openings or grooves 313, 314, 315 and fixed in the right position. In FIG. 4, four posts 216, 217, 218, 219 and four openings or grooves 316, 317, 318, 319 are on the base of the post 210 and opening or groove 310 in FIG. 1 used as a reference and according to clockwise or counterclockwise direction to set up 45, 135, 225 and 315 degree respectively, when combining, the four posts 216, 217, 218, 219 being simultaneously inserted into three openings or grooves 316, 317, 318, 319 and fixed in the right position. The elements, which are set up for combination, can be inserted into the right position, unable to be inserted into the non-combinable lamp base and lamp holder at the right position. Further, the numbers of the posts and opening or groove can be varied and the fixed angles also can be varied so as to form more combining configurations.

According to the lamp socket device in FIGS. 5, 6/7 and 8, at the waist of the lamp base 22 having a annular protuberance 302, on the protuberance 302, four openings or grooves 320, 321, 322, 323, 324, 325 and 326, 327, 328, 329 respectively; the upper rim of the neck 28 of lamp base 22 having an annular protuberance 202, four posts 220, 221, 222, 223, 224, 225 and 226, 227, 228, 229 respectively extended toward the direction of the neck 28 on the protuberance 202; the length of post being larger than that ofthe upper rim of the protuberance of lamp holder. In FIG. 5, one post 220 and one opening or groove 330 are to be set up in the same side. When combining, the base 29 and neck 28 of the lamp base 22 are inserted into the opening of lamp holder, the post 220 simultaneously inserted into the opening or groove 320 and fixed in the right position. In FIG. 6, two posts 221, 222 and two openings or grooves 321, 322 are on the base of the post 220. The opening or groove 320 in FIG. 5 is used as a reference to set up 90 degree respectively, when combining, the two posts 221, 222 being simultaneously inserted into two openings or grooves 321, 322 and fixed in the right position. In FIG. 7, three posts 223, 224, 225 and three openings or grooves 323, 324, 325 are on the base ofthe post 220 and opening or groove 320 in FIG. 5 is used as a reference and according to clockwise or counterclockwise direction to set up 30, 150 and 270 degree respectively, when combining, the three posts 223, 224, 225 being simultaneously inserted into three openings or grooves 323, 324, 325 and fixed in the right position. In FIG. 8, four posts 226, 227, 228, 229 and four openings or grooves 326, 327, 328, 329 are on the base of the post 220 and opening or groove 320 in FIG. 5 is used as a reference and according to clockwise or counterclockwise direction to set up 45, 135, 225 and 315 degree respectively, when combining, the four posts 226, 227, 228, 229 being simultaneously inserted into three openings or grooves 326, 327, 328, 329 and fixed in the right position. According to the lamp socket device in FIGS. 9, 10, 11 and 12, an upper rim of neck 28 of the lamp base 23 has a annular protuberance 203, on the protuberance 203, four posts 230, 231, 232, 233, 234, 235 and 236, 237, 238, 239 respectively extended toward the direction of the neck 28. The opening rim of the connected portion between the lamp holder 33 with lamp bulb 1 and lamp base 23 has an upper part 303, four openings or grooves 330, 331, 332, 333, 334, 335 and 336, 337, 338, 339 on the upper part 303. In FIG. 9, one protuberance part 230 and one opening or groove 330 are to be set up in the same side. When combining, the base 29 and neck 28 of the lamp base 23 are inserted into the opening of lamp holder, the protuberance part 230 simultaneously inserted into the opening or groove 330 and fixed in the right position. In FIG. 10, two protuberance parts 231, 232 and two openings or grooves 331, 332 are on the base of the protuberance part 230. Opening or groove 330 in FIG. 9 is used as a reference set up 90 degrees respectively. When combining, the two protuberance parts 231, 232 are simultaneously inserted into two openings or grooves 331, 332 and fixed in the right position. In FIG. 11, three protuberance parts 233, 234, 235 and three openings or grooves 333, 334, 335 are on the base of the protuberance part 230 and opening or groove 330 in FIG. 9 is used as a reference and according to clockwise or counterclockwise direction to set up 30, 150 and 270 degree respectively, when combining, the three protuberance parts 233, 234, 235 being simultaneously inserted into three openings or grooves 333, 334, 335 and fixed in the right position. In FIG. 12, four protuberance parts 236, 237, 238, 239 and four openings or grooves 336, 337, 338, 339 are on the base of the protuberance part 230 and opening or groove 330 in FIG. 9 is used as a reference and according to clockwise or counterclockwise direction to set up 45, 135, 225 and 315 degree respectively, when combining, the four posts 236, 237, 238, 239 being simultaneously inserted into three openings or grooves 336, 337, 338, 339 and fixed in the right position.

According to the lamp socket device in FIGS. 13, 14, 15 and 16, an upper rim of neck 28 of the lamp base 24 has an annular protuberance 204, on the protuberance 204, four openings or grooves 240, 241, 242, 243, 244, 245 and 246, 247, 248, 249 respectively extended toward the direction of the neck 28; the opening rim of the connected portion of the lamp holder 34 with lamp bulb 1 and lamp base 24 having four protuberances 340, 341, 342, 343, 344, 345 and 346, 347, 348, 349. In FIG. 13, one opening or groove 240 and one protuberance part 340 are to be set up in the same side. When combining, the base 29 and neck 28 of the lamp base 24 are inserted into the opening of lamp holder, the protuberance part 340 is simultaneously inserted into the opening or groove 240 and is fixed in the right position. In FIG. 14, two openings or grooves 241,324 and two protuberance parts 341, 342 are on the base of the opening or groove 240 and protuberance part 340 in FIG. 13 is used as a reference to set up 90 degree respectively, when combining, the two protuberance parts 341, 342 being simultaneously inserted into two openings or grooves 241, 242 and fixed in the right position. In FIG. 15, three openings or grooves 243, 244, 245 and three protuberance parts 343, 344, 345 are on the base of the opening or groove 240 and protuberance part 340 in FIG. 13 is used as a reference and according to clockwise or counterclockwise direction to set up 30, 150 and 270 degree respectively, when combining, the three protuberance parts 343, 344, 345 being simultaneously inserted into three openings or grooves 243, 244, 245 and fixed in the right position. In FIG. 16, four openings or grooves 246, 247, 248, 249 and four protuberance parts 246, 247, 248, 249 are on the base of the opening or groove 240. The protuberance part 340 in FIG. 13 is used as a reference and according to a clockwise or counterclockwise direction to set up 45, 135, 225 and 315 degree respectively, when combining, the four protuberance parts 346, 347, 348, 349 being simultaneously inserted into three openings or grooves 246, 247, 248, 249 and fixed in the right position.

The lamp socket devices shown in FIGS. 17, 18, 19 and 20, are similar to FIGS. 1, 2, 3 and 4, however, the sizes of the post, opening or groove are different. In FIG. 17, the width of the post 250 and one opening or groove 350 is most largest. In FIG. 18, the width of the two posts 251, 252 and two openings or grooves 351, 352 is smaller than those of in FIG. 17. In FIG. 19, the width of the three posts 253, 254, 255 and three openings or grooves 353, 354, 355 is smaller than those of in FIG. 18. In FIG. 20, the width of the four posts 256, 257, 258, 259 and four openings or grooves 356, 357, 358, 359 is smaller than those of in FIG. 19. Thus, the number of posts and openings or grooves in one is the largest in size; the size of two posts and openings or grooves in two is smaller than those in one; the size of three posts and openings or grooves is also smaller than in two; and the size of four posts and openings or grooves is the smallest. Therefore, a lamp base or lamp holder having one post, opening or groove is unable to be inserted into a lamp holder or lamp base having two or more than two openings or grooves or posts; a lamp base or lamp holder having two posts, opening or grooves is unable to be inserted into a lamp holder or lamp base having three or more than three openings or grooves or posts; and a lamp base or lamp holder having three posts, opening or grooves is unable to be inserted into a lamp holder or lamp base having four openings or grooves or posts. Such will be increased more assembling configurations.

The above embodiments are only for the illustration and not to limit to the above mentioned structures of combinations. The main purpose is to set up the lamp bulb, lamp base and lamp holder having acceptance, selectively combinable, aspects with directional aspects between the fixed lamp bulb, lamp base and lamp holder whereas the other unfixed lamp bulb, lamp base and lamp holders of a similar but different type have non-acceptance, non-combinable or exclusive aspects. The Tables 1, 2 and 3 below are used to provide a more detailed explanation.

TABLE 1

| | | Post or Protuberance Opening or Groove | |
|---|---|---|---|
| | Model Nos. | number | Spaced Angle |
| Lamp base | B - X - 1 | 1 | 360 |
| or | H - X - 1 | | |
| Lamp Bulb | B - X - 2 | 2 | 180 |
| B - X | H - X - 2 | | |
| Lamp Holder | B - X - 3 | 3 | 120 |
| H - X | H - X - 3 | | |
| | B - X - 4 | 4 | 90 |
| | H - X - 4 | | |
| | B - X - 5 | 5 | 72 |
| | H - X - 5 | | |
| | B - X - 6 | 6 | 60 |
| | H - X - 6 | | |
| | . . . | . . . | . . . |

TABLE 2

EXPLANATION:

| | | | | |
|---|---|---|---|---|
| Shown in solid line: | | | | |
| 1. acceptableness | B-X-1 | B-X-2 | B-X-3 | B-X-Y |
| 2. combinableness | ↕ | ↕ | ↕ | ↕ |
| 3. selectiveness | | | | |
| 4. monopolization | | | | |
| 5. directionality | H-X-1 | H-X-2 | H-X-3 | H-X-Y |
| Shown in dotted line: | | | | |
| 1. non-acceptableness | B-X-1 | B-X-2 | B-X-3 | B-X-Y |
| 2. non-combinableness | ↕ | ↕ | ↕ | ↕ |
| 3. exclusiveness | | | | |
| | H-X-2 | H-X-1 | H-X-1 | H-X-1 |
| | H-X-3 | H-X-1 | H-X-1 | H-X-1 |
| | H-X-4 | H-X-1 | H-X-1 | H-X-1 |
| | ⋮ | ⋮ | ⋮ | ⋮ |
| | H-X-Y | H-X-Y | H-X-Y | H-X-(Y-1) |

TABLE 3

| | | | | | |
|---|---|---|---|---|---|
| Lamp Base or Lamp Bulb | | | | | |
| Type | B-X-1 | B-X-2 | B-X-3 | B-X-Y. . . | B-X-Y |
| | ↕ | ↕ | ↕ | ↕ | ↕ |
| Lamp Holder | | | | | |
| Type | H-X-1 | H-X-2 | H-X-3 | H-X-4. . . | H-X-Y |

B-X = The models of Lamp Base or Lamp Bulb.
H-X = The models of Lamp Holder.
Y = The numbers of post or protuberance, opening or groove, such as: 1, 2, 3, 4, ...

What I claimed is:

1. A system for properly matching lamp bulbs having different specifications with lamp holders having respective matching specifications comprising:

a first light string set with first lamp bulb having first lamp bulb specifications; a first lamp base receiving said first lamp bulb; said first lamp base having an outer circumferential surface with a first number of protrusions having a width and a length relative to said circumferential surface, the protrusions being distributed about the circumferential surface, the adjacent protrusions being spaced an equal distance from each other about the circumferential surface; a first lamp holder having the first lamp bulb specifications and a first number of receptacles formed about an outer circumferential surface of said lamp holder and being spaced apart and dimensioned for receiving said first protrusions; wherein said first number of protrusions and receptacles are the same;

a second light string set with second lamp bulb having second lamp bulb specifications, a second lamp base receiving said second lamp bulb; said second lamp base having an outer circumferential surface with a second number of protrusions each having a width and a length relative to said circumferential surface, the protrusions being distributed about the circumferential surface, the adjacent protrusions being spaced an equal distance from each other about the circumferential surface; a second lamp holder having the second lamp bulb specifications and a second number of receptacles receiving said second protrusions; wherein said second number of protrusions and receptacles are the same;

wherein, said first number of said first protrusions and receptacles is less than said second number of said second protrusions and receptacles and said first protrusions and receptacles are wider than said second protrusions and receptacles; whereby said first lamp bulb will only be received by said first lamp holder and the second lamp bulb will only be received by said second lamp holder.

2. The lamp socket device system according to claim 1, wherein said first lamp bulb specifications are for use in one of series or in parallel with a number of devices on a string and said second lamp bulb specifications are for use in one of series or in parallel with a number of devices on a string and wherein:

said first lamp bulb specifications are for series use and said second lamp bulb specifications are for parallel use or for series use with a different number of devices on a string, as compared to said first lamp bulb specifications; or said first lamp bulb specifications are for parallel use and said second lamp bulb specifications are for series use or for parallel use with a different number of devices on a string, as compared to said first lamp bulb specifications.

3. The lamp socket device system according to claim 1 further comprising a third light string set having protrusions and recesses which differ in number from said first light string set and said second light string set, said third light string set having different specifications from said first light string set and said second light string set the space between adjacent protrusions and recesses of said third light string set being different from that of said first light string set and said second light string set.

4. A lamp socket device system for decorative lighting strings, the system comprising:

a first lighting string set type having a lamp bulb, a lamp base, a lamp holder, a contact sheet and electrical wires, and a first lighting string set type lamp base to lamp holder connection;

another lighting string set type with a lamp bulb, lamp base and lamp holder of a similar but different type from said first lighting string set type, and another type lighting string set lamp base to lamp holder connection, said first lighting string set type lamp base to lamp holder connection being different and not compatible with said another type lighting string set lamp base to lamp holder connection, wherein the first lighting string set type has specifications for use in series or in parallel with the same number of lighting string sets on a string wherein said another lighting string set type has different specifications, each lamp base and holder connection having an outer circumferential surface of the lamp base and inner and outer circumferential surfaces of the lamp holder and having a number of protrusions having a width and a length relative to said circumferential surface, the protrusions being distributed about the circumferential surface of the lamp base, the adjacent protrusions being spaced an equal distance from each other about the inner or outer circumferential surface of the lamp holder, the receptacles being spaced apart and dimensioned for receiving said protrusions; wherein said first number of protrusions and receptacles are different for different lighting string sets, wherein the specifications of the first lighting string set type and the another lighting string set type include number of lamp assemblies per string and/or the wattage of the lamp.

5. A lamp socket lighting string set system according to claim 4, wherein the protrusion of the lamp base of each of said first lighting string set type and said another lighting string set type includes one or more posts extending therefrom, and the lamp holder of said first lighting string set type and said another lighting string set has a lamp holder circular skirt portion defining one or more post receiving regions, the numbers of posts and the numbers of post receiving regions of said first lighting string set type being different from the number of posts and the numbers of post receiving regions of said another lighting string set type.

6. A lamp socket lighting string set system according to claim 5, wherein the number of the posts and the numbers of post receiving regions of said first lighting string set type is one and that of said another lighting string set type is two.

7. The lamp socket lighting string set system according to claim 5 wherein further lighting string set types are provided, each lighting string set type having different specifications and having posts associated with the lamp base and post receiving regions associated with the lamp holder, said first lighting string set type, said another lighting string set type and said further lighting string set types having a number of posts and post receiving regions equal to one of 0, 1, 2, 3, 4, 5 and 6 with an angle between adjacent posts and grooves of a lighting string set type being different from an angle between adjacent posts and grooves of a different lighting string set type.

8. A lamp socket lighting string set system according to claim 4, wherein the lamp base of each of said first lighting string set type and said another lighting string set type includes one or more posts extending therefrom, and the lamp holder of said first lighting string set type and said another lighting string set has a lamp holder circular skirt portion defining one or more post receiving regions, said one or more posts and said one or more post receiving regions of said first lighting string set type having different dimensions from said one or more posts and said one or more post receiving regions of said another lighting string set type.

9. A lamp socket lighting string set system according to claim 8, wherein said different dimensions comprise different widths.

10. A lamp socket lighting string set system according to claim 8, wherein said different dimensions comprise different shapes.

* * * * *